United States Patent [19]

Genoa et al.

[11] Patent Number: 4,969,837

[45] **Date of Patent: * Nov. 13, 1990**

[54] ELECTRIFIED VACUUM CLEANER HOSE ADAPTER

[75] Inventors: Joseph Genoa, Freeport; Harold Kaskel, Long Beach, both of N.Y.; Carl Nelson, Wyckoff, N.J.

[73] Assignee: Atlantic Vacuum Parts Corp., Long Beach, N.Y.

[ * ] Notice: The portion of the term of this patent subsequent to May 2, 2006 has been disclaimed.

[21] Appl. No.: 309,617

[22] Filed: Feb. 10, 1989

Related U.S. Application Data

[63] Continuation of Ser. No. 29,458, Mar. 23, 1987, Pat. No. 4,826,444, which is a continuation-in-part of Ser. No. 675,949, Nov. 28, 1984, Pat. No. 4,652,063.

[51] Int. Cl.[5] ..... H01R 4/64

[52] U.S. Cl. ..... 439/191

[58] Field of Search ..... 439/191, 192; 285/7; 174/47; 15/377

[56] References Cited

U.S. PATENT DOCUMENTS

| | | | |
|---|---|---|---|
| D. 287,896 | 1/1987 | Genoa et al. | D32/32 |
| 2,202,989 | 6/1940 | Kitto | 439/191 |
| 3,553,629 | 1/1971 | Brown et al. | 439/191 |
| 3,614,705 | 10/1971 | Descarries | 439/191 |
| 4,018,493 | 4/1977 | Lyman et al. | 439/191 |
| 4,385,790 | 5/1983 | Genoa | 439/191 |
| 4,473,923 | 10/1984 | Neroni et al. | 15/377 |
| 4,494,270 | 1/1985 | Ritzau et al. | 439/191 |
| 4,634,197 | 1/1987 | Horlacher, Jr. | 439/192 |

*Primary Examiner*—Neil Abrams

*Attorney, Agent, or Firm*—Frishauf, Holtz, Goodman & Woodward

[57] ABSTRACT

An electrified vacuum cleaner hose adapter for electrically and mechanically interconnecting an electrified vacuum cleaner hose with an electrified vacuum cleaner wand or accessory, comprises a handle portion which includes two tubular portions set at an angle to each other, an inlet member for connecting to a vacuum cleaner hose and an outlet member for connecting to the vacuum cleaner wand or accessory. Electrical connectors are provided at each end of the handle portion of the adapter for connecting with corresponding electrical conductors of the hose and wand, respectively. Electrical conductors extend between the connectors. The connectors and the electrical conductors are covered by a projecting member which defines a closed passage in the handle portion for enclosing the electrical connectors and conductors and for serving as a manually grippable protrusion on the handle portion. A switch may be provided in the projecting portion to control the electrified wand or accessory connected to the adapter. The projecting portion can be integrally formed in one piece with the handle portion, for example by injection molding. Also, one or both of the inlet and outlet tubular members can be integrally formed in one piece with the handle portion by injection molding.

24 Claims, 5 Drawing Sheets

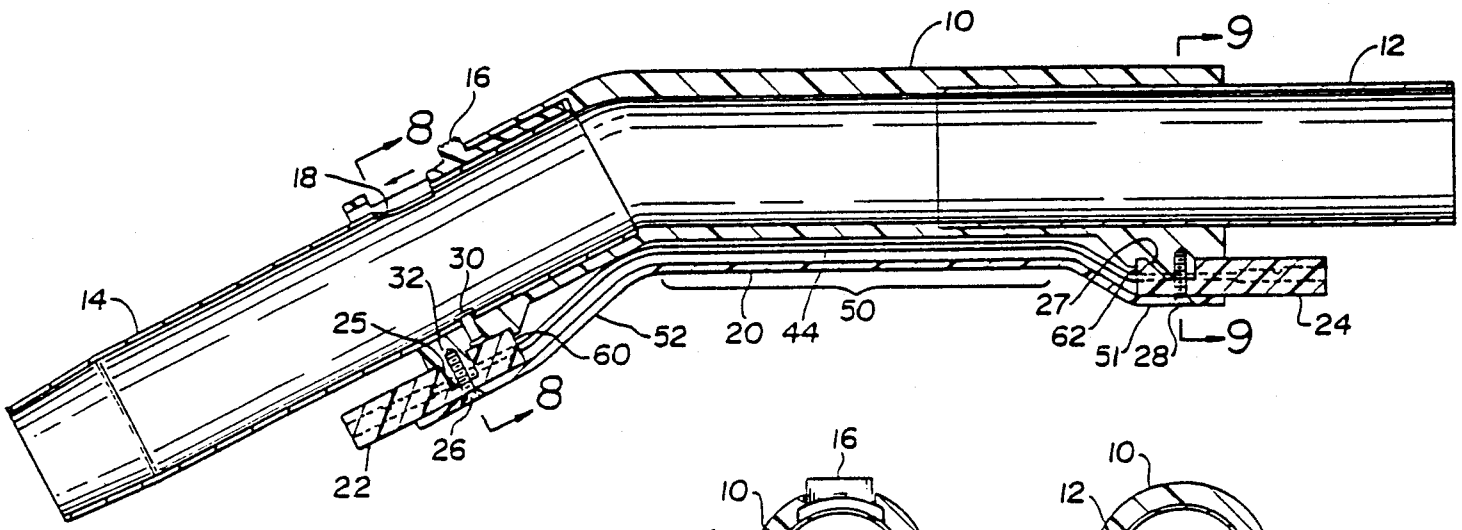
FIG.7
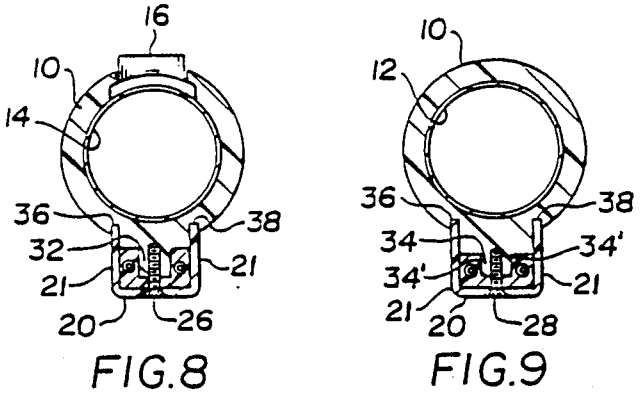
FIG.9
FIG.8
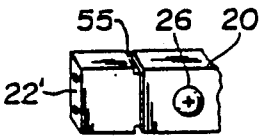
FIG.10
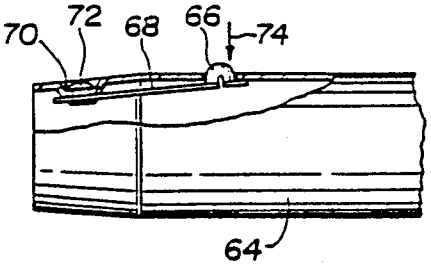
FIG.11

17
17
10
12
14
16
18
20
22
24
25
26
27
28
30
32
44
50
51
52
62
110
111
120
122
124
125
126
127
128
129
130
131
150
160
230
232
234

ELECTRIFIED VACUUM CLEANER HOSE ADAPTER

CROSS REFERENCE TO RELATED APPLICATION

This is a continuation of application Ser. No. 029,458, filed Mar. 23, 1987, now U.S. Pat. No. 4,826,444, which in turn is a CIP application of Ser. No. 675,949, filed Nov. 28, 1984, which issued as U.S. Pat. No. 4,652,063 on Mar. 24, 1987.

BACKGROUND OF THE INVENTION

This invention relates to an electrified vacuum cleaner hose adapter, and more particularly to a hose adapter having a handle portion which is gripable by a user, and which interconnects an electrified vacuum cleaner hose with an electrified vacuum wand and working implement, such as a rug beater or the like.

In many instances, various manufacturers of vacuum cleaners make specialized interconnecting devices which are not readily obtainable, or which are obtainable only at relatively high price. On the other hand, many manufacturers make generic replacement parts which are adapted for use with many different types of vacuum cleaners, but not for all.

It is the main object of the present invention to provide an electrified vacuum cleaner hose adapter which permits using conventional, relatively low-priced generic type electric hoses in combination with electrified vacuum cleaner attachments such as wands having rug-beaters at the end thereof.

SUMMARY OF THE INVENTION

According to the present invention, an electrified vacuum cleaner hose adapter for interconnecting an electrified vacuum cleaner hose with an electrified wand or accessory, comprises a generally tubular main handle member which has a first generally tubular portion integral with a second tubular portion, the first and second tubular portions having longitudinal axes which are at an angle with each other; an inlet member including a tubular section extending from one end of the handle portion and which is receivable in an opening of an electrified vacuum cleaner hose; and an outlet member including a tubular section extending from the other end of the handle portion and which is receivable in an opening of an electrified vacuum cleaner wand or accessory. The adapter further comprises a first connector connected to the end portion of the handle portion adjacent the outlet member and having electrical contacts for matingly and electrically connecting with an electrical connector of the electrified wand or accessory; and a pair of electrical conductors extending between and electrically connecting the first and second connectors. An elongated projecting portion, which also serves as a manually grippable member, is integrally formed as one piece with the main handle member and protudes from the main handle member over a substantial portion of the length of the main handle member. The projecting portion extends between the first and second connector means and defines a covered passage between the connectors, the electrical conductors extending within the covered passage so as not to be exposed to the outside of the covered passage. The protruding portion of the projecting portion which at least partly defines the covered passage also defines a manually grippable, slip resistant portion of the adapter when a user's hand is gripped around the adapter.

BRIEF DESCRIPTION OF THE DRAWINGS

FIG. 7 is a sectional view thereof showing the internal mechanisms and electrical interconnecting means;

FIG. 8 is a section taken along line 8—8 in FIG. 7;

FIG. 9 is a sectional view taken along line 9—9 in FIG. 7;

FIG. 10 illustrates a modified connector member;

FIG. 11 illustrates another embodiment of the outlet member;

DETAILED DESCRIPTION

Figure 1:
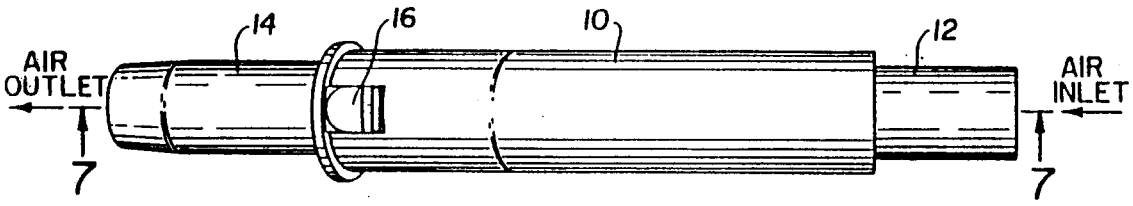
FIG. 1 is a plan view of a vacuum cleaner hose adapter according to the present invention.

Referring to FIGS. 1–6, the electrified vacuum cleaner hose adapter of the present invention generally comprises a substantially tubular handle portion 10 (preferably made of plastic material), a substantially tubular inlet member 12 (preferably made of metallic material) and substantially tubular outlet member 14 (preferably made of metallic material). A slidable air throttle control 16 is provided for selectively opening and closing an opening 18 in the hose adapter. The air throttle control is generally conventional and does not form a novel feature of the present invention.

Figure 3:
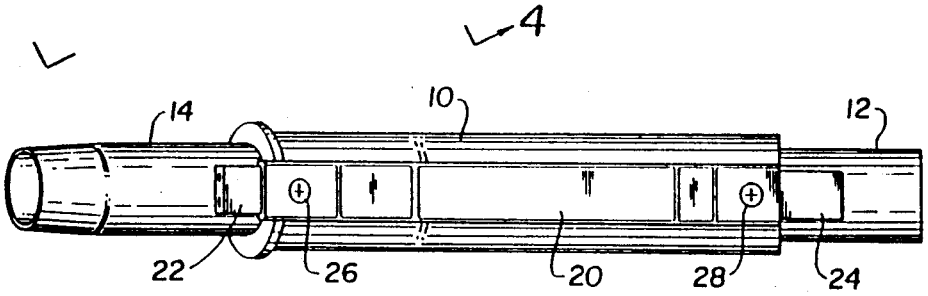
FIG. 3 is a bottom view thereof.
Figure 4:
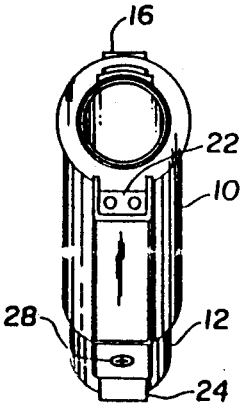
FIG. 4 is an end view thereof as seen along the line 4—4 in FIG. 2.
Figure 5:
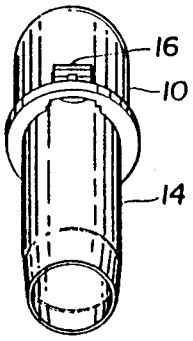
FIG. 5 is a left end elevational view thereof with respect to FIG. 2.
Figure 6:
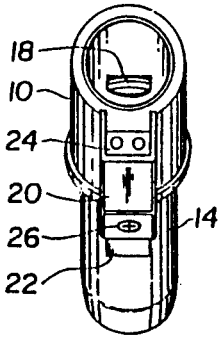
FIG. 6 is a right end elevational view thereof with respect to FIG. 2.

At the lower portion of the handle portion 10 a channel-type housing 20 is provided with electrified female plugs 22,24 extending from opposite ends thereof. The housing 20 is preferably retained within notches or cut-outs formed in the handle portion 10 (to be described later) and is secured in place by means of screws 26,28, as best seen in FIG. 3.

In use, the inlet member 12 is inserted into a receiving opening of an electrified vacuum cleaner hose which has an electrical connector at the end thereof which electrically and mechanically matingly engages with the plug 24. The parts are preferably adhesively or otherwise fixedly connected together so that the electrified hose and the adapter of the present invention are secured together as an integral unit. The interconnection is preferably by means of an adhesive, but may be by means of screws or other interconnecting elements, as desired. The left hand end or outlet member 14 is insertable into a receiving opening in a vacuum cleaner wand which has a connector at the receiving end thereof, the connector of the wand mating with connector 22 physically and electrically to provide electrical power from the electrified hose, through the adapter of the present invention, and to the wand, which has an electrical implement at the remote end thereof, such as a rug beater. The interconnection of outlet member 14 with the wand is preferably not made permanent. In general usage, the wand is disconnected from the adapter of the present invention for ease of storage of the various parts. Since the electrical connector 22 at the outlet end of the adaptor of the present invention is a female connector, there is no danger of electric shock or the like when the wand is disconnected from the outlet member 14 of the adaptor. Since the inlet member 12 is fixedly and permanently received in the hose, there is no danger of electric shock from any exposed electrical connector parts.

Referring to FIGS. 7–9, the invention will be described further in greater detail. The handle portion 10 is preferably made of a plastic material (ABS) and is generally of a bent tubular shape. The forward end of the handle portion 10 receives an outlet member 14, which is preferably a tubular metallic member, which is secured within the handle portion 10 preferably by means of a rivet 30, as shown in FIG. 7. Alternatively, the outlet tube 14 may be bonded to the forward end of the handle portion 10, and a rivet can be used to strengthen the bonded interconnection. Similarly, the inlet member 12 is a generally tubular metallic member and is preferably molded directly to the interior of handle portion 10, as shown in FIG. 7. The other surface of portion 12 may be roughened or otherwise conditioned to improve adhesion to handle portion 10 during and after molding.

The handle portion 10 has a protrusion 32 extending downwardly therefrom at the outlet end portion thereof, and a protrusion 34 extending downwardly therefrom at the inlet end portion thereof. As seen in FIGS. 8 and 9, the handle portion 10 has grooves 36,38 formed along the surface thereof between the protrusions 32,34, and in which the generally U-shaped channel-shaped housing 20 is received. The housing 20 is fixedly and removably connected to the handle portion 10 preferably by means of screws 26,28. Other connecting means, such as rivets, adhesives or the like, could be used to connect the housing 20 with the handle portion 10. Screws 26,28 (or rivets) are preferred since not only do these members serve to connect the housing 20 with the handle portion 10, but they also serve to retain the connectors in position in the longitudinal direction of the adapter. The connectors 22,24 have cut-out portions 25,27, respectively, which matingly engage with the protrusions 32,34 of the handle member 10. This mating engagement effectively "locks" and retains the connectors 22,24 in place, and the screws 26,28 serve to securely retain the members in their fixed, locked position. The protrusions 32,34 have different shapes, so that the respective connectors 22,24 are engageable with only a given one of the protrusions 32,34. Protrusion 32 is generally cylindrical and protrusion 34 is generally trapezoidal with flat sides 34'. The flat sides 34' reduces twisting of the connector on the protrusion. The sides of the protrusion 32 may also be flat for the same reason. The handle portion 10 also has stop members 60,62 molded integrally therewith, against which the rear surfaces of the connectors 22,24, respectively engage. These "stop" members 60,62 inhibit the connectors 22,24 from moving backward during engagement thereof with their respective mating connectors on the vacuum cleaner hose and wand. The stop members 60,62 are also preferably substantially flat in the plane perpendicular to the page of FIG. 7, and engage with substantially flat rear end surfaces of the connectors 22,24, thereby also preventing twisting of the connectors relative to the handle portion 10, during engagement thereof with mating connectors, and also during use of the device.

Extending between connectors 22,24 is a pair of wires 44 which respectively interconnect the pair of receptacles of the connectors 22,24. Thus, electrical power received from a vacuum cleaner hose which is connected at the inlet end 12 is transferred to the receptacles of the connector 24, through the wires 44, to the pin receptacles of the connector 22, and then to the vacuum cleaner wand and electrical accessory through interconnection with the connector 22. While the connectors 22,24 are shown as being female connectors, it should be clear that male connectors may be used for one or both of the connectors 22. To increase safety, in some instances it may be desirable to use a male connector in place of connector 24, which will mate with a live female connector of the electrified vacuum cleaner hose. In the unlikely event of the adapter of the present invention becoming disconnected from the electrified hose, this would prevent exposure of live connectors at the end of the electrified vacuum cleaner hose.

The channel-shaped housing 20 has substantially flat side walls 21 which contact substantially flat side walls of the connectors 22,24, as seen in FIGS. 8 and 9. This engagement helps stabilize the connectors 22,24 to further inhibit twisting of the connectors either during interconnection or during use of the device. By virtue of the engagement of the connectors with the respective protrusions 32,34, the end-stops 60,62, the side wall engagement with the channel sides 21 and the locking engagement with the screws 26,28, the connectors 22,24 are firmly held in place to inhibit breakage or movement relative to the adaptor, either during interconnection with other connectors, or during use of the device by a user, even under extreme use and handling conditions.

The arrangement of the present invention not only provides proper electrical connection to enable interconnecting a conventional generic-type hose with a vacuum cleaner electrified wand, but also provides a handle member 10 with a convenient hand gripping portion 50 (see FIG. 7). In use, the user's hand grips the handle portion 10 around the area 50, with the fingers of the hand extending over and around housing 20. The downwardly extending portion 51 of the housing 20 serves as a "stop" to prevent the user's hand from inadvertently slipping rearwardly on the handle portion 10, and the forward downwardly extending portion 52 of the housing 22 serves effectively as a "stop" to prevent slipping of the user's hand past the angularly curved forward portion of the adapter. The housing 20 also extends downwardly of the handle portion 10 (see FIGS. 2 and 7). This provides a protruding gripping portion to prevent slipping of the user's hand circumferentially of the handle portion 10. By virtue of the above arrangement of the housing 20 relative to the handle member 10, a convenient and secure gripping of the adaptor of the present invention is achieved, even when the user's hands are dirty, or slippery due to perspiration, grease or the like. Thus, the protruding housing serves not only as a convenient grip-improving member and slippage reducing member, it also serves as the hollow housing for passing the wire between the connectors, without requiring that the air passage through the adaptor of the present invention be reduced to accommodate the wires 44. Since the housing 20 is removably secured to the handle portion 10, the connectors and wire may be replaced, if necessary.

Figure 2:
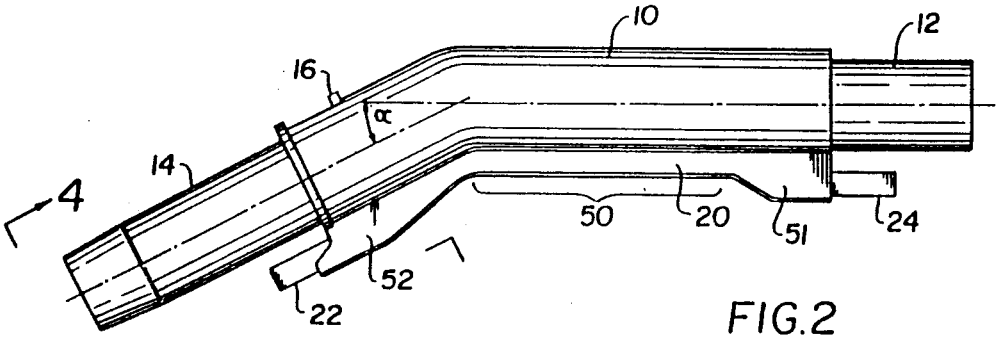
FIG. 2 is a side elevational view thereof.

Another important feature of the present invention is the angular disposition between the outlet member 14 and the inlet member 12. As seen in FIG. 2, the angle between the center lines of members 12 and 14 is preferably approximately 27°. This provides a very convenient operating angle between the hand gripping portion 50 of the handle portion 10 and the wand which connects to outlet member 14. Other similar angles, such as from about 25° to 30° may be used. The prior art angular relationship of 45° has been found to be inconvenient and more difficult to use.

FIG. 10 shows a modified embodiment wherein the connector 22' is enlarged at the portion thereof which extends outwardly from channel 20. This improves the interengagement of the connector 22' with the channel 20 and increases the strength of the resultant arrangement. The connector 22' is shown slightly spaced from the channel member 20 in FIG. 10 for clarity, but in practice, the space 55 does not exist-the connector is preferably in contact with the end of the channel 20. Similarly, the connector 24 at the other end of the adaptor can be enlarged at the portion thereof which extends outwardly of the channel.

FIG. 11 shows another embodiment of an outlet member 14 to enable the device to be usable with various specific types of vacuum cleaner wands. Referring to FIG. 11, the outlet member 64, the tip end of which is shown for ease of illustration, comprises a spring-mounted button member 66, which engages into a corresponding opening of a vacuum wand (not shown). The button 66 is integral with a leaf spring member 68 which is connected at a depression 70 of outlet member 66 via a rivet 72. The button member 66 springs downwardly in the direction of the arrow 74 during engagement with the vacuum cleaner wand, and springs outwardly when it is in registration with the corresponding opening or hole (not shown) of the vacuum cleaner wand.

Figures 12, 13, 14:
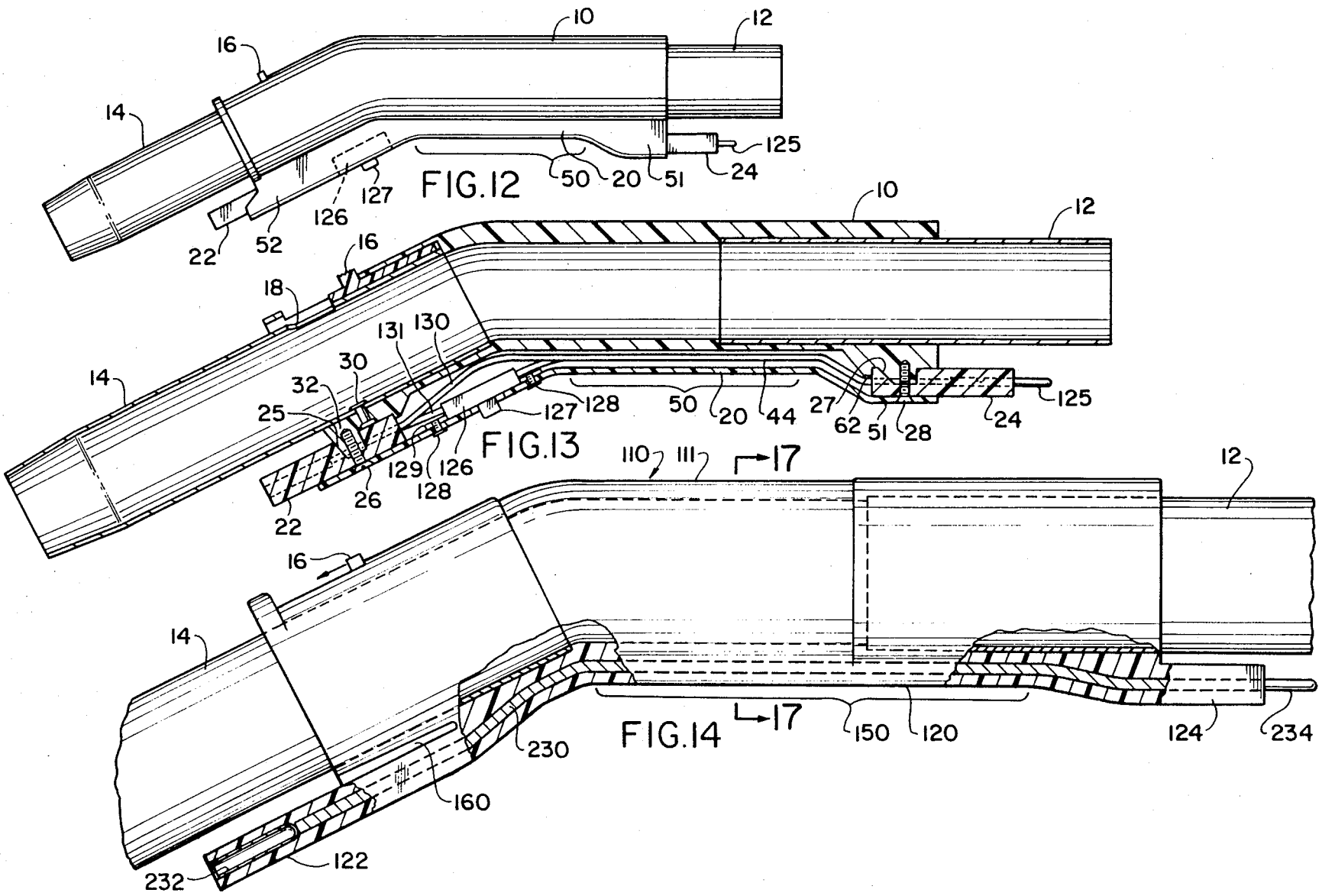
FIG. 12 illustrates a modified embodiment of the invention incorporating a switch.
FIG. 13 is a sectional view of the embodiment of FIG. 12.
FIG. 14 illustrates another modified embodiment of the invention wherein the main handle member is an integrally molded one-piece structure, shown partly in section.

Referring to FIGS. 12 and 13, a modified embodiment of the present invention including a switch 126 is shown. In FIGS. 12 and 13, the same reference numerals as used in the previous figures are used, where applicable, for ease of description. FIG. 12 shows the switch 126 with its operating member 127 in a schematic manner to show its orientation. In FIG. 12, the connector member 24 has a pair of male conducting projections (i.e. electrical contacts) 125 extending therefrom. The male connector members 125 project into receiving female connector members in a vacuum cleaner hose which is to be connected to the adapter 10 of the present invention. This arrangement is for safety in the event that the adapter becomes disconnected from the electrified vacuum cleaner hose.

Referring to FIG. 13, the switch construction is shown in greater detail. The switch 126 can be connected to the projecting housing member 20 either by means of an adhesive or by means of screws 128 which connect to flanges 129 of the switch 126. Rivets could be used in place of screws 128. One of the electrical conductors 130 extends from one contact of connector member 22 to one contact of connector member 24 in an uninterrupted manner. The other conductor member 131 extends from the other contact of connector member 22 to the switch 126, and then extends from the other side of the switch 126 to the other projecting conductor 125 of connector member 24. When the switch 126 is "on", the conductor 131 provides a complete electrical connection between connector members 22 and 24. When the switch 126 is off, the electrical connection through conductor 131 is broken, thereby turning off the electrified accessory which is connected to the outlet end 14 of the adapter 10. This arrangement provides convenient control for the electrified accessory connected to the outlet end of the adapter 10, without the necessity of turning on and turning off the vacuum cleaner per se in order to control the accessory. This is particularly convenient when the user is using a power nozzle (with a power driven rotating brush) on carpets and then wishes to move directly onto bare floors. This is easily accomplished by switching off the power nozzle with the switch 126, enabling the continuing of vacuuming without interruption. In known machines this ease of operation is not available. The switch 126 and its connection to conductor 131 is shown generally schematically in FIG. 13. In practice, the switch 126 preferably will have connectors (i.e. spade-type lugs) thereon to which the ends of the conductor 131 are to be attached, (i.e., by a connector engageable with the spade-type lugs) as is known.

Figure 16:
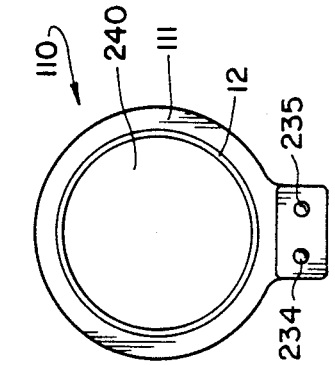
FIG. 16 is a right end view of the embodiment of FIG. 14.

FIGS. 14–17 illustrate another embodiment of the invention wherein the adapter 110 comprises a one-piece integrally molded main handle member 111, which is preferably made of a non-conductive plastic material such as, for example, acrilonitrile butadiene styrene resin (ABS). Other suitable non-conductive plastic materials are, for example, polyvinyl chloride resins (PVC), blends of ABS and PVC, Lexan, and other similar materials. Integrally molded with the main handle member 111 is an elongated projecting portion 120 which extends from the lower portion of handle member 111 and which has a pair of electrical conductors 230, 231 embedded therein (see also FIG. 17). Only one conductor 230 is seen in FIG. 14, the other conductor 231 being directly therebehind. The electrical conductors 230, 231 are preferably stiff, brass rods which are bent to a tortuous shape such as that shown in FIG. 14. The rods can be copper, steel or other suitable metal. The metal rods 230, 231 are integrally molded with the main handle member 111 and projecting portion 120 during the molding thereof. The respective electrical conductors, 230, 231 have female receptacles 232, 233 connected to the ends thereof before they are molded into the main handle member 111. The other ends of the respective electrical conductors 230, 231 have projecting male electrically conducting members 234, 235 extending therefrom, as seen in FIGS. 14 and 16. The male projecting conducting members 234, 235 can be extensions of the conductors 230, 231, or attached thereto. The female connectors 232, 233 are preferably connected to the opposite ends of conductors 230, 231, for example by welding or other suitable connection technique. The male conducting members 234, 235 project from connector member 124 and the female connectors 232, 233 are housed in connector member 122. Connector members 122, 124 are integrally molded with the main handle member 111 and projecting portion 120 as one integral piece.

The conducting rods 230, 231 are preferably bent in a tortuous manner, such as shown in FIG. 14, so that when they are molded in place in the lower projecting portion 120 of the integrally formed handle member 111, they will become securely locked in place, thereby preventing relative movement therebetween. Other tortuous shapes could be used to provide this result.

Gripping portion 150 of the main handle member 111 comprises a projecting portion 120 (see FIG. 17) which projects downwardly from the main substantially round portion of the handle member 111 to serve as a gripping member for a user. The provision of the projecting portion 120 over the extent 150 enables the user to securely grip the adapter 110 and minimizes of slippage of the user's hand during use. Also, the projecting portion 120 provides sufficient material within which to embed and mold the electrical conductors 230, 231 so that the electrical conductors 230, 231 do not impinge upon the hollow space 240 within the interior of the tubular main handle member 111. This means that a full area will be provided for unobstructed air flow so that maximum air flow can be achieved.

Connector members 122, 124 integrally extend from opposite ends of the main handle member 111 and respectively house the female receptacles and the male projections. The connector members 122, 124 are functionally identical with the connector members 22, 24 described in the previous embodiments, except that they are integrally molded with the remainder of the main handle member 111, as seen in FIGS. 14–17.

The metallic tubular members 12, 14 are inserted into the opposite ends of the main handle member 111 as shown in FIG. 14, in a manner similar to the previously described embodiments. The tubular members 12, 14, are preferably adhered to the main handle member 111. Additionally, or alternatively, a rivet or the like can be provided between the main handle member 111 and the respective tubular members 12, 14 to improve the security of the connections therebetween.

Figure 15:
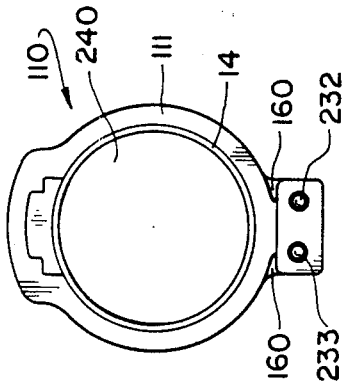
FIG. 15 is a left end view of the embodiment of FIG. 14.

A necked down relief area 160 is provided at the left end of main handle member 111, as best seen in FIG. 14 and 15. This necked down area is provided in order to reduce the amount of plastic material at this portion of the device in order to reduce strinkage as the plastic material hardens immediately after molding. As is known in the plastics art, if the mass of plastic is too great, it will shrink upon hardening after injection molding. It has been found by necking down the area 160 as shown in FIGS. 14 and 15, the shrinkage problem is reduced, product appearance and function are improved, and the resulting configuration still has a high structural integrity. The necked down portion 160 also provides a convenient gripping area for gripping the part when assembling the vacuum cleaner wand to the adapter 110.

In the embodiment of FIGS. 14–17, the slide 16 is constructed substantially the same and operates in the same manner as in the previously described embodiments.

The projecting portion 120 could project to the interior of the adapter 110 instead of to the exterior, but this would obstruct air flow through the adapter. However, in some instances, such a construction may be acceptable. However, such a construction would not provide the gripping portion 150. Preferably, the gripping portion 150 should be provided. Such constructions are described later with reference to FIGS. 22–24.

Figure 18:
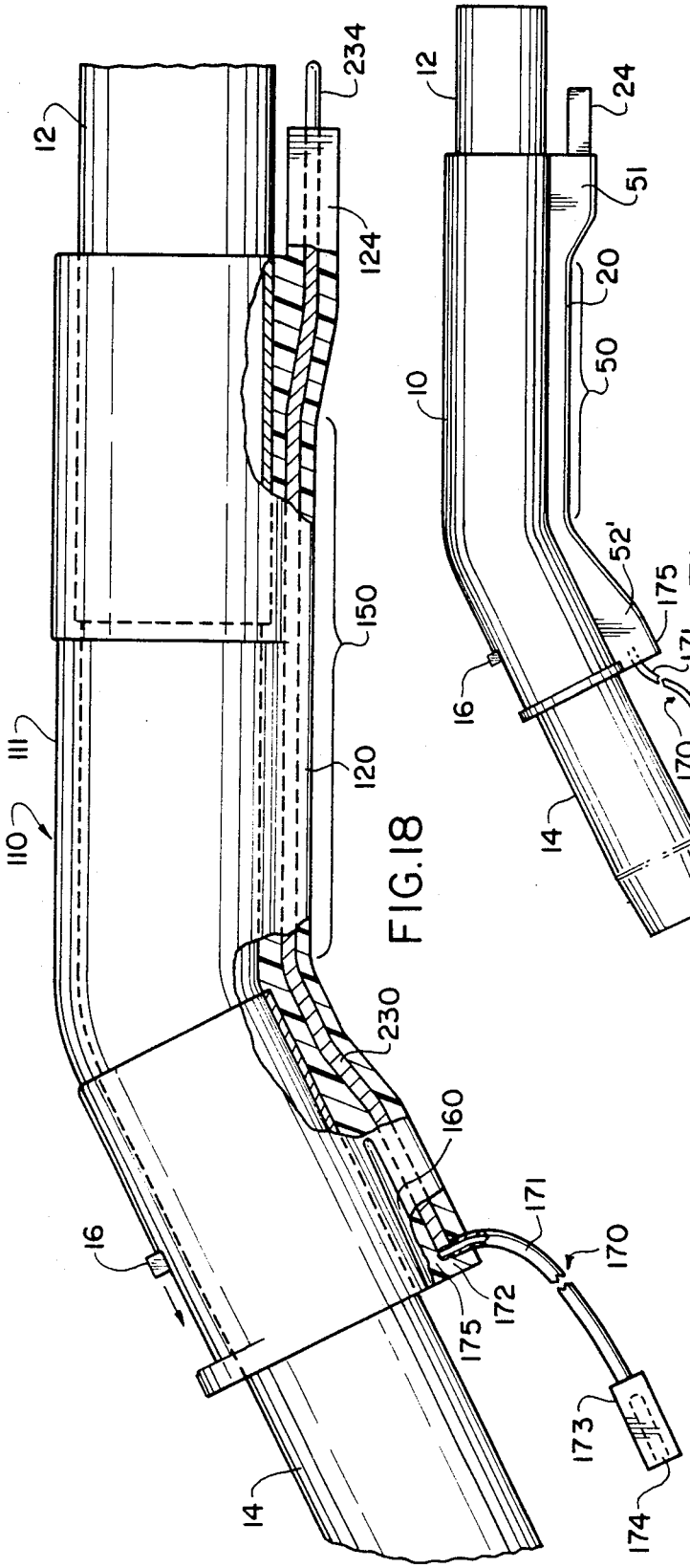
FIG. 18 shows a modification of the embodiment of FIG. 14.

FIG. 18 illustrates an embodiment similar to FIG. 14, but wherein the connector 122 is replaced by a pigtail type of lead 170 which comprises an insulated pair of conductors 171 which are connected to the conductive rods 230, 231, respectively, and which exit from the end portion 172 adjacent the end of the main handle member 111. The electrical conductors within the wires 171 are connected to the elongated conductors 230, 231, respectively, by conventional means, such as by welding, soldering or the like. The wire 171 is terminated in a female connector member 173 having a pair of female receptacles 174 therein which plug into male connectors at the end of the vacuum cleaner wand or electrified accessory which is to be connected to the adapter via the tubular member 14. Alternatively, the insulated wire 171 can exit from the main handle member 111 from wall 173, if desired. The arrangement of FIG. 18 is suitable for situations wherein the electrified accessory which is to be connected to the adaptor 110 of the present invention does not have a plug which is arranged to mate with connectors such as those shown in the previous embodiments.

Figure 19:
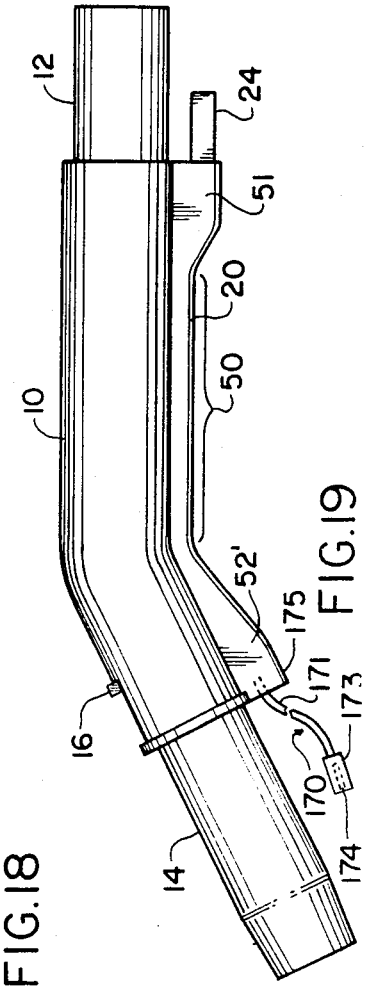
FIG. 19 shows a modification of the embodiment of FIGS. 1–9.

FIG. 19 shows a modification of the embodiment of FIG. 2 which is configured with a pigtail type of lead 170, similar to that of FIG. 18. The pigtail lead may be connected to the electrical conductors running within the projecting member 20 by screw connections, soldering or other connections, as may be desired. Alternatively, the wires 171 can be integrally formed with the electrical conductors 44 which extend through the projecting member 20. The pigtail lead 170 may exit from member 52' along the wall 175, if desired.

Figure 17:
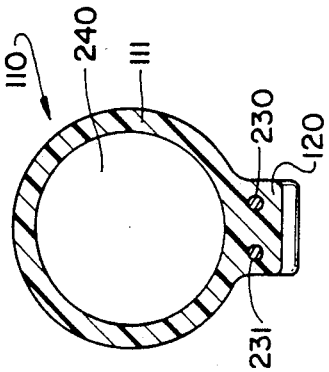
FIG. 17 is a sectional view taken along the line 17—17 in FIG. 14.
Figures 20, 21, 22, 23, 24, 25:
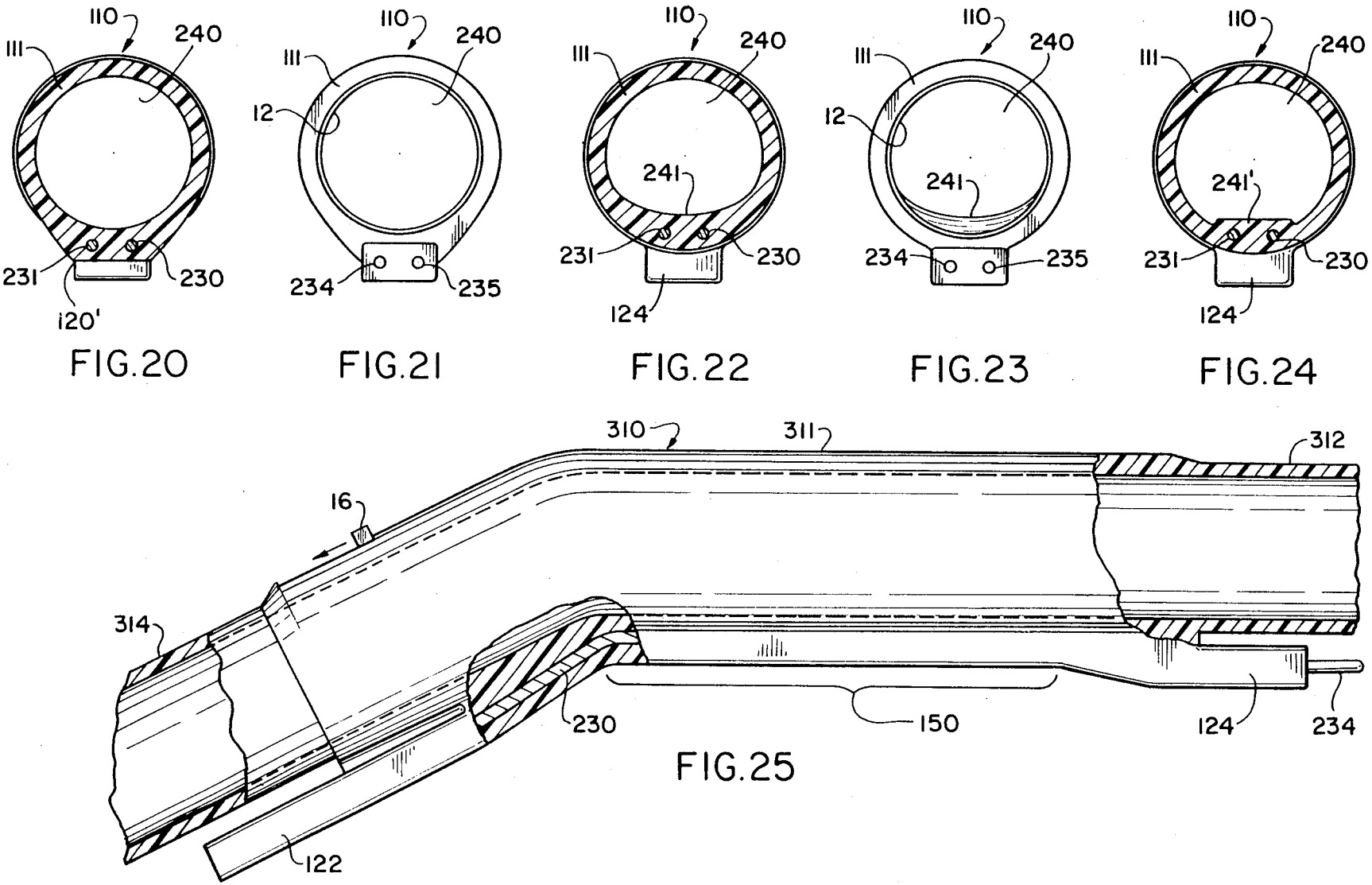
FIGS. 20–24 show respective modifications of the embodiment of FIGS. 14–18.
FIG. 25 shows another embodiment wherein the inlet and outlet tubular members are molded as one piece with the main handle member, portion 120 and connector members 122, 124.

FIGS. 20 and 21 are views similar to FIGS. 16 and 17, but illustrating a modified embodiment wherein the portion 120 does not protrude in a distinct manner. In this embodiment, the outer configuration of the main handle portion 110 is somewhat oval at the lower portion thereof so as to provide sufficient material at the lower portion thereof to contain the conductors 230, 231.

FIGS. 22 and 23, which are also similar views as FIGS. 16 and 17, illustrate a further modification of the invention wherein the outer periphery of the main handle portion 110 is substantially round, and the inner periphery thereof is oval at the bottom portion to provide sufficient material for containing the conductors 230, 231. This embodiment has the disadvantage that the inner periphery 240 of the adapter somewhat restricts the air flow due to its reduced size at the lower portion thereof. In some instances, however, this configuration may be acceptable. The lower portion 241 may be configured as shown in FIG. 24.

In side view (see FIG. 14), the protruding portion 120 would not protude to the same extent as shown in FIG. 18 when the arrangement is modified in accordance with FIGS. 20–24. In such modifications, the thicker portions of the plastics area which houses the conductors 230, 231 would protrude into the cylindrical opening 240, as indicated in the embodiments of FIGS. 22, 23 and 24. In the modified embodiments of FIGS. 20 and 21, the circular or cylindrical opening 240 remains obstructed.

FIG. 25 illustrates a modification of the embodiment of FIG. 14 wherein the tubular members 12, 14 of FIG. 14 are integrally formed with the main handle member 310 (corresponds to member 110 in FIG. 14) as one piece in a single molding operation. That is, the tubular members 312, 314 at opposite ends of the main handle portion 311 are integrally formed with main handle member 311 of the same plastic material. The tubular members 312, 314 terminate at their free ends substantially in the same manner as illustated in FIGS. 1–3. The tubular member 314 preferably has a tapered end at the free end thereof for ease of insertion into a wand or other accessory.

Instead of both end tubular members 312, 314 being integrally formed as one piece with the main handle member 311 during a molding operation, only the inlet tubular member 312 can be integrally formed as one piece with the main handle member 311 of the same material as handle member 311, during the initial molding operation. The outlet tubular member 314 can be made of metal, as in the embodiment of FIGS. 1–9, and inserted as shown in the earlier embodiments, and retained in place by an adhesive, rivets, etc.. The particular configuration wherein the outlet tubular member 14 is metallic and the inlet tubular member 312 is integrally formed with the main handle member 311 during molding is not shown, but should be readily apparent in view of this description and from the other figures.

While the invention has been described above with respect to specific embodiments, it should be clear that various modifications and alterations can be made within the scope of the appended claims. Also, various components from the different embodiments can be combined, as required, and desired, to produce specific desired configurations within the scope of the appended claims.

We claim:

1. An electrified vacuum cleaner hose adapter for interconnecting an electrified vacuum cleaner hose with an electrified wand or accessory, comprising:

a generally tubular main handle member (110) comprising a first generally tubular portion integral with a second generally tubular portion, said first and second tubular portions being integrally formed as one unitary piece and having respective longitudinal axes which are at an angle with each other;

a tubular inlet member (12) at one end portion of said first tubular portion and which is receivable in an opening of an electrified vacuum cleaner hose;

a tubular outlet member (14) at one end portion of said second tubular portion and which is receivable in an opening of an electrified vacuum cleaner wand or accessory;

first electrical connector means integrally formed as one unitary piece with said first tubular portion at the one end portion of said first tubular portion adjacent said inlet member (12) and having electrical contacts for matingly and electrically connecting with an electrical connector of said electrified vacuum cleaner hose;

second electrical connector means integrally formed as one unitary piece with said second tubular portion at the one end portion of said second tubular portion adjacent said outlet member (14) and having electrical contacts for matingly and electrically connecting with an electrical connector of said electrified wand or accessory;

a pair of electrical conductors extending between and electrically connecting said first and second electrical connector means; and an elongated projecting member (120) integrally formed as one unitary piece with said main handle member and protruding from said main handle member over at least a substantial portion of the length of said main handle member and extending between said first and second electrical connector means and defining a covered insulated passage between said first and second electrical connector means, for insulating said electrical conductors from each other and from the outside, said electrical conductors extending within said covered passage so as not to be exposed to the outside of said covered passage, a protruding portion of said projecting member (120) at least partly defining said covered passage and also defining a fixed, manually grippable, slip resistant portion (150) of said adapter substantially along said first tubular portion for engagement with a user's hand when a user's hand is gripped around said first tubular portion of said adapter.

2. The adapter of claim 1, wherein said protruding portion of said projecting member extends between said first and second connector means.

3. The adapter of claim 2, wherein said protruding portion of said projecting member comprises an intermediate section (150) which protrudes from said main handle member by a predetermined amount, a forward portion which protrudes from said main handle member by an amount greater than said intermediate portion, and a rear portion which protrudes from said main handle member by an amount greater than said intermediate portion, said forward and rear protruding portions serving as stop members to prevent a hand of a user from sliding forward or rearward, respectively, past said stop members.

4. The adapter of claim 3, wherein said forward and rear protruding portions protrude from said main handle member by an amount substantially greater than said intermediate portion.

5. The adapter of claim 4, wherein said projecting member has sloping portions between said intermediate portion and said rear and forward portions, respectively, said sloping portions serving as said stop members.

6. The adapter of claim 1, further comprising rivet means extending through said outlet member (14) and into said main handle member (110) for fixedly and mechanically connecting said outlet member (14) to said main handle member (110) to prevent relative movement therebetween.

7. The adapter of claim 3, further comprising rivet means extending through said outlet member (14) and into said main handle member (110) for fixedly and mechanically connecting said outlet member (14) to said main handle member (110) to prevent relative movement therebetween.

8. The adapter of claim 5, further comprising rivet means extending through said outlet member (14) and into said main handle member (110) for fixedly and mechanically connecting said outlet member (14) to said main handle member (110) to prevent relative movement therebetween.

9. The adapter of claim 1, further comprising screw means extending through said outlet member (14) and into said main handle member (110) for fixedly and mechanically connecting said outlet member (14) to said main handle member (110) and to prevent relative movement therebetween.

10. The adapter of claim 1, wherein said main handle member, said protruding portion, said first and second connector means, and at least one of said inlet member and said outlet member are all integrally formed as one piece by injection molding.

11. The adapter of claim 1, wherein said main handle member, said protruding portion and said first and second electrical connector means are all integrally formed as one piece by injection molding.

12. The adapter of claim 11, wherein said pair of electrical conductors are each substantially rigid tortuously bent electrical conductors which are molded into said projecting member.

13. An electrified vacuum cleaner hose adapter for interconnecting an electrified vacuum cleaner hose with an electrified wand or accessory, comprising:

a generally tubular main handle member comprising a first generally tubular portion integral with a second generally tubular portion, said first and second tubular portions having respective longitudinal axes which are at an angle with each other;

a tubular inlet member at one end portion of said first tubular portion and which is receivable in an opening of an electrified vacuum cleaner hose;

a tubular outlet member at one end portion of said second tubular portion and which is receivable in an opening of an electrified vacuum cleaner wand or accessory;

first electrical connector means coupled to the one end portion of said first tubular portion adjacent said inlet member and having electrical contacts for matingly and electrically connecting with an electrical connector of said electrified vacuum cleaner hose;

second electrical connector means coupled to the one end portion of said second tubular portion adjacent said outlet member and having electrical contacts for matingly and electrically connecting with an electrical connector of said electrified wand or accessory;

a pair of electrical conductors extending between and electrically connecting said first and second electrical connector means;

an elongated projecting member fixedly coupled to said main handle member and protruding from a lower side of said main handle member over at least a substantial portion of the length of said main handle member and extending between said first and second electrical connector means and defining a covered passage between said first and second electrical connector means, said electrical conductors extending within said covered passage so as not to be exposed to the outside of said covered passage, a protruding portion of said projecting member at least partly defining said covered passage and also defining a manually grippable, slip resistant portion of said adapter substantially along said first tubular portion for engagement with a user's hand when a user's hand is gripped around said first tubular portion of said adapter;

switch means coupled to said projecting member and being electrically connected to one of said electrical conductors to selectively open and close a conducting path between said conductor means, said switch means being operable by a user when a suer grips said first tubular portion of said adapter; and coupling means for fixedly coupling said elongated projecting member to said main handle member without any screw means, elongated connecting members or the like passing through said elongated projecting member or through said coupling means to said main handle member, such that it is immovable relative to said main handle member to positively prevent said elongated projecting member from moving circumferentially around said main handle member during use, thereby maintaining structural integrity, grippability and safety during use.

14. The adapter of claim 13, wherein said protruding portion of said projecting member extends between said first and second connector means.

15. The adapter of claim 14, wherein said protruding portion of said projecting member comprises an intermediate section (150) which protrudes from said main handle member by a predetermined amount, a forward portion which protrudes from said main handle member by an amount greater than said intermediate portion, and a rear portion which protrudes from said main handle member by an amount greater than said intermediate portion, said forward and rear protruding portions serving as stop members to prevent a hand of a user from sliding forward or rearward, respectively, past said stop members.

16. The adapter of claim 15, wherein said forward and rear protruding portions protrude from said main handle member by an amount substantially greater than said intermediate portion.

17. The adapter of claim 16, wherein said projecting member has sloping portions between said intermediate portion and said rear and forward portions, respectively, said sloping portions serving as said stop means.

18. The adapter of claim 13, wherein said main handle member has protruding members at the opposite ends thereof, and wherein said first and second connector means (22, 24) have respective openings therein for engaging with said protruding members 19. The adapter of claim 18, wherein said protruding members have stop means and wherein said first and second connector means have respective rear surfaces which face toward the central portion of said main handle member and which are in contact with said stop means of said main handle member for preventing movement of said first and second connector means toward the central portion of said handle portion.

20. An electrified vacuum cleaner hose adapter for interconnecting an electrified vacuum cleaner hose with an electrified wand or accessory, comprising:

a generally tubular main handle member comprising a first generally tubular portion integral with a second generally tubular portion, said first and second tubular portions being integrally formed as one unitary piece and having respective longitudinal axes which are at an angle with each other;

a tubular inlet member at one end portion of said first tubular portion and which is receivable in an opening of an electrified vacuum cleaner hose;

a tubular outlet member at one end portion of said second tubular portion and which is receivable in an opening of an electrified vacuum cleaner wand or accessory;

first electrical connector means integrallY formed as one unitary piece with said first tubular portion at the one end portion of said first tubular portion adjacent said inlet member and having electrical contacts for matingly and electrically connecting with an electrical connector of said electrified vacuum cleaner hose;

second electrical connector means integrally formed as one unitary piece with said second tubular portion at the one end portion of said second tubular portion adjacent said outlet member and having electrical contacts for matingly and electrically connecting with an electrical connector of said electrified wand or accessory;

a pair of electrical conductors extending between and electrically connecting said first and second electrical connector means; and an elongated member integrally formed as one unitary piece with said main handle member and having a thickness greater than that of said main handle member over at least a substantial portion of the length of said main handle member and extending between said first and second electrical connector means and defining a covered insulated passage between said first and second electrical connector means, for insulating said electrical conductors from each other and from the outside, said electrical conductors extending within said covered passage so as not to be exposed to the outside of said covered passage.

21. The adapter of claim 20, wherein said elongated member protrudes from the lower portion of said main handle member.

22. An electrified vacuum cleaner hose adapter for interconnecting an electrified vacuum cleaner hose with an electrified wand or accessory, comprising:

a generally tubular main handle member comprising a first generally tubular portion integral with a second generally tubular portion, said first and second tubular portions being integrally formed as one unitary piece and having respective longitudinal axes which are at an angle with each other;

a tubular inlet member at one end portion of said first tubular portion and which is receivable in an opening of an electrified vacuum cleaner hose;

a tubular outlet member at one end portion of said second tubular portion and which is receivable in an opening of an electrified vacuum cleaner wand or accessory;

first electrical connector means integrallY formed as one unitary piece with said first tubular portion at the one end portion of at least one of said first tubular portion and said second tubular portion, and having electrical contacts for matingly and electrically connecting with an electrical connector of one of said electrified vacuum cleaner hose and said electrified wand or accessory;

second electrical connector means integrally formed at the end of a flexible pair of conductors extending from the one end portion of the other of said first and second tubular portions, said second connector means having electrical contacts for matingly and electrically connecting with an electrical connector of the other of said electrified vacuum cleaner hose and said electrified wand or accessory;

a pair of electrical conductors extending between and electrically connecting said first electrical connector means and said flexible conductor; and an elongated member integrally formed as one unitary piece with said main handle member and having a thickness greater than that of said main handle member over at least a substantial portion of the length of said main handle member and extending between said first and second electrical connector means and defining a covered insulated passage between said first and second electrical connector means, for insulating said electrical conductors from each other and from the outside, said electrical conductors extending within said covered passage so as not to be exposed to the outside of said covered passage.

23. The adapter of claim 22, wherein said first connector means is coupled to said one end portion of said first tubular portion, and said flexible conductors extend from the one end portion of said second tubular portion.

24. The adapter of claim 22, wherein said elongated member protrudes from the lower portion of said main handle member.

* * * * *